United States Patent [19]

Haines

[11] 4,290,264

[45] Sep. 22, 1981

[54] STIRLING CYCLE APPARATUS

[75] Inventor: Derrick J. Haines, Letchworth, England

[73] Assignee: British Aerospace Public Limited Company, London, England

[21] Appl. No.: 4,923

[22] Filed: Jan. 19, 1979

[30] Foreign Application Priority Data

Jan. 21, 1978 [GB] United Kingdom ..... 2487/78

[51] Int. Cl.[3] ..... F02G 1/06

[52] U.S. Cl. ..... 60/518; 60/517; 60/525

[58] Field of Search ..... 60/518, 525, 517, 519; 62/6

[56] References Cited

U.S. PATENT DOCUMENTS

| | | | |
|---|---|---|---|
| 2,465,139 | 3/1949 | Van Weenen et al. | 60/518 |
| 3,742,719 | 7/1973 | Lagodmos | 60/518 X |
| 3,994,136 | 11/1976 | Polster | 60/518 |

*Primary Examiner*—Allen M. Ostrager
*Assistant Examiner*—Stephen F. Husar
*Attorney, Agent, or Firm*—Cushman, Darby & Cushman

[57] ABSTRACT

Stirling cycle apparatus including a compressor or expander for cyclically compressing or expanding a working gas, a displacer for cyclically displacing the working gas, a rotatable shaft, and a drive mechanism for coupling the compressor or expander and the displacer to the shaft, the drive mechanism being such that the relative timing of their operating cycles can be altered. Additionally a low vibration compressor or expander is provided.

15 Claims, 10 Drawing Figures

STIRLING CYCLE APPARATUS

This invention relates to apparatus which utilises the Stirling cycle of operation. Such apparatus has application alternatively as a prime mover or as a heat pump.

Stirling cycle apparatus has a closed cycle of operation in which a working fluid is cyclically compressed or expanded in a first zone by working means, and is cyclically moved to and from a second zone, in which the working fluid temperature is increased by energy absorption, by displacing means operated cyclically with the working means.

In Stirling cycle apparatus, whether a prime mover or a heat pump, it is found that the cycling, that is to say the timing, of the motion of the displacing means relative to that of the working means is preferably varied according to the function that the apparatus is required to perform or is performing. Accordingly, an objective of the present invention is the provision of driving means for the working means and the displacing means which allow variation of the timing.

Stirling cycle apparatus, moreover, may be required to operate in environments where low levels of vibration are necessary. Accordingly, an objective of the present invention is the provision of working means and means to drive the working means which have suitably low vibration levels in operation.

According to the present invention, Stirling cycle apparatus includes working means for cyclically compressing or expanding a working fluid, displacing means for cyclically displacing the working fluid, rotatable shaft means, and drive means operatively associating the working means and the displacing means with the shaft means, said drive means being such that the relative timing of the operating cycles of the working means and the displacing means can be altered.

Preferably, to provide low levels of vibration, the working means includes a plurality of piston/cylinder units symmetrically disposed with the axes of reciprocation of the pistons tangential to an imaginary circle lying in a plane normal to the rotational axis of the shaft means and centred upon said rotational axis. In this case the drive means preferably includes a rotatable member coaxially mounted with the shaft means, a mechanism arranged to effect reciprocatory rotational movement of the rotatable member, and connecting means connecting the pistons to the rotatable member.

A preferred embodiment of Stirling cycle apparatus according to the invention is described with reference to the accompanying drawings in which:

FIG. 1 is a block diagram of a typical Stirling cycle heat pump, in this case a cooling device, FIG. 2 is a similar diagram to that of FIG. 1 but illustrating a typical Stirling cycle prime mover, that is to say an engine, FIG. 3 is a cross-sectional side elevation of a heat pump suitable for cooling purposes, the cross section being in a plane including the axis of symmetry X—X, that is to say on lines III—III indicated on FIGS. 4 and 5.

Figure 3:
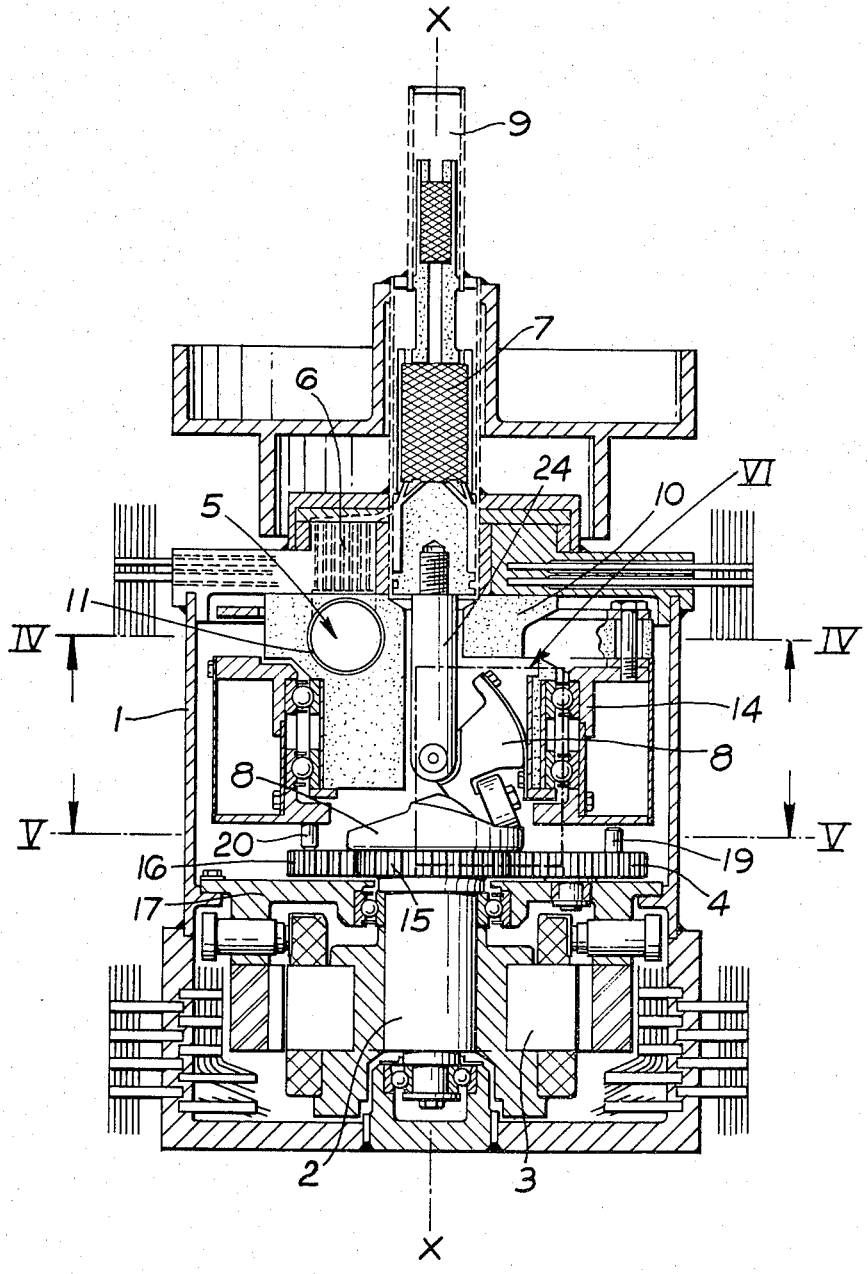
Figure 5:
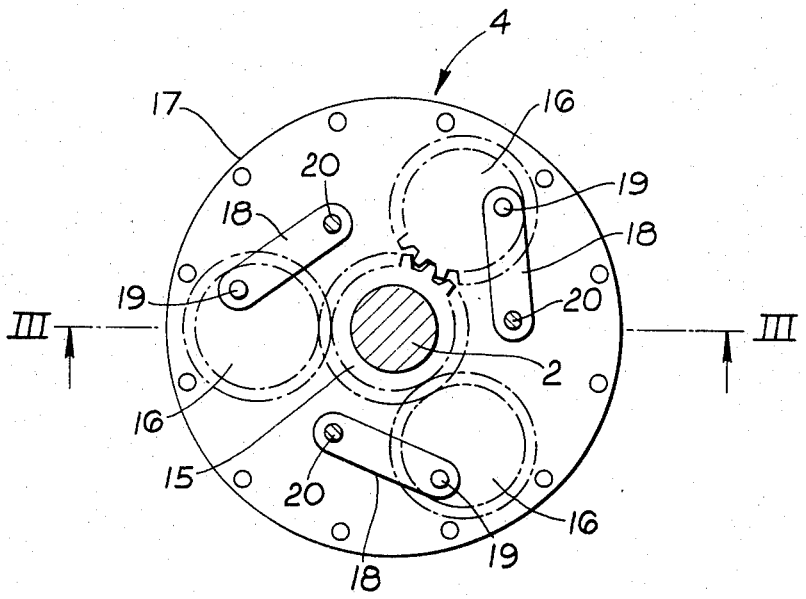
FIG. 5 is a cross-section taken about line V—V of FIG. 3.
Figure 6:
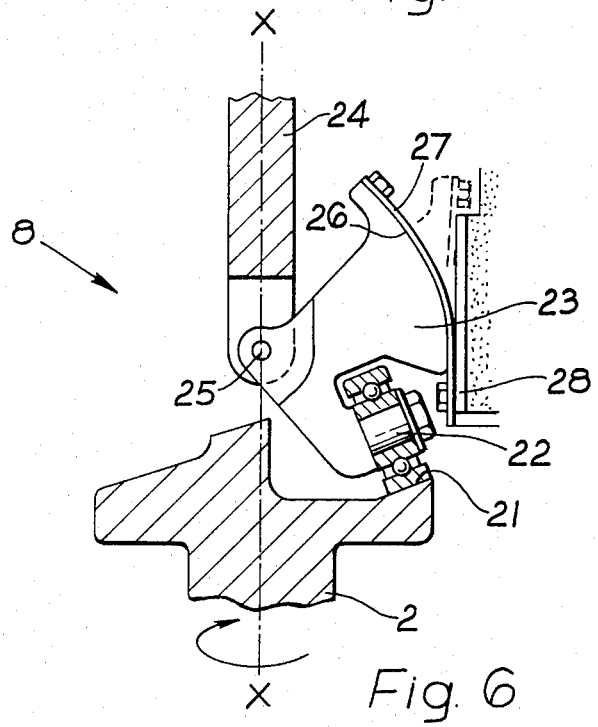
Figure 7:
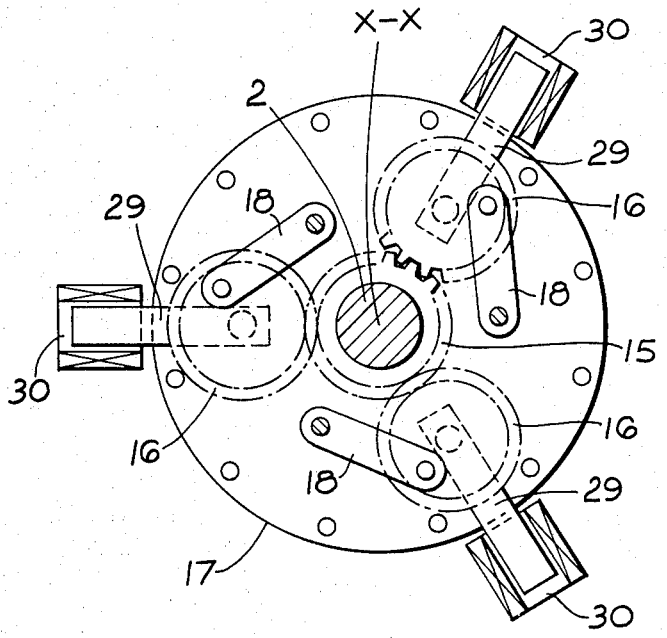
Figure 8:
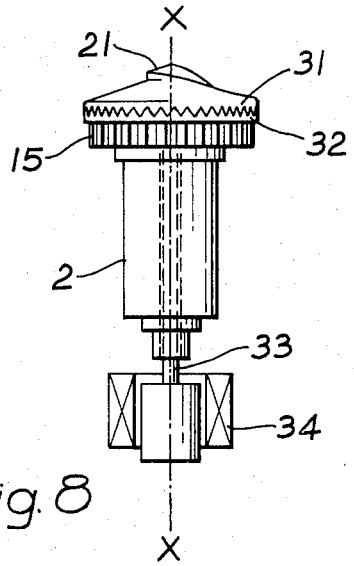
Figure 9:
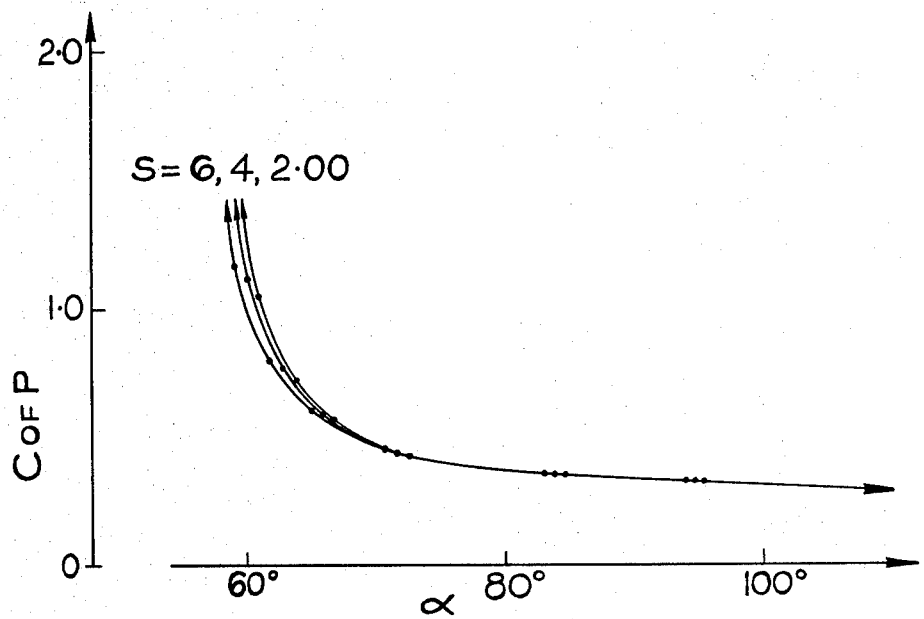
Figure 10:
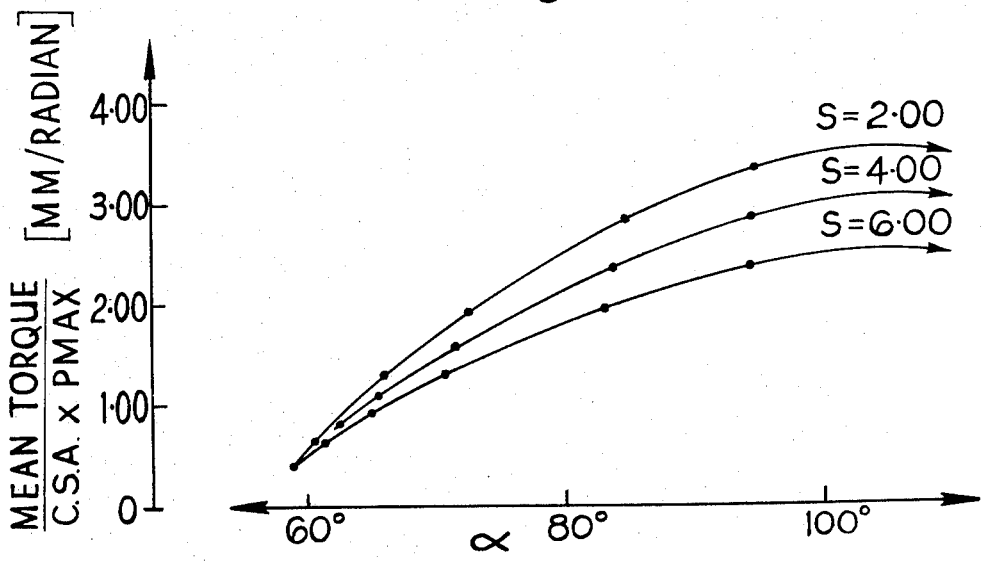

FIG. 6 is an enlarged, partly cross-sectioned view of the mechanism in box VI of FIG. 3, FIG. 7 is a similar view to that of FIG. 5 but illustrating one arrangement for effecting timing variation, FIG. 8 is a view of part of FIG. 3 illustrating a further arrangement for effecting timing variation, FIG. 9 is a graph of Coefficient of Performance plotted against Phase Angle, and FIG. 10 is a graph of Mean Torque divided by C.S.A. multiplied by Pmax plotted against Phase Angle. (C.S.A. and Pmax are defined below).

Figure 1:
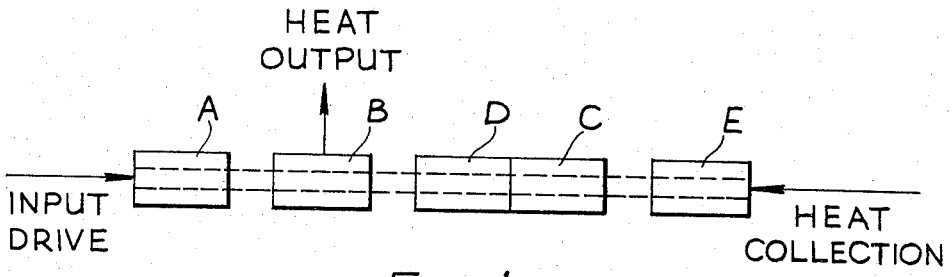

In FIG. 1, a heat pump used for cooling purposes, has a working gas which is compressed by working means A and heat is dissipated to atmosphere by heat exchanger means B. The working gas is displaced by displacing means C through regenerator means D to absorption means E, heat being delivered to the regenerator means D thereby cooling the working gas before it reaches the absorption means E. On reaching the absorption means E, the cold working gas absorbs heat from an external apparatus to be cooled, is subsequently displaced back into the working means A, and, in doing so, passes through the regenerator means D to accept stored heat therefrom. In the meantime, the working means A approaches a low compression state to accept the displaced working gas and, on initiation of a further cycle, compresses the working gas to effect further heat dissipation to atmosphere. The movements of the displacing means C normally lead the movements of the working means A by up to half of one mechanical cycle.

The working means A are driven by external means not shown.

Figure 2:
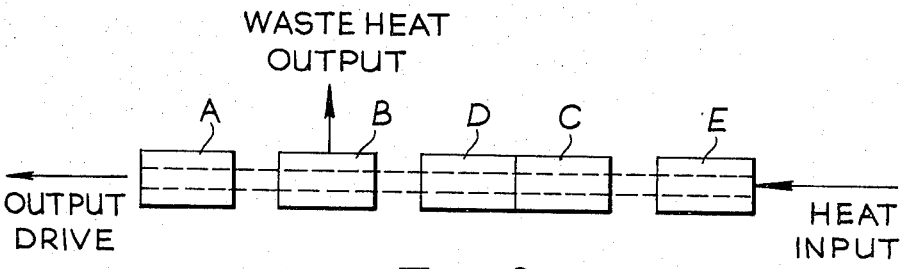

FIG. 2, in which like reference letters relate to like components of FIG. 1, illustrates a prime mover which operates in a similar manner to the cooling device of FIG. 1 except that the absorption means E is arranged to absorb thermal energy from an external energy source (that is to say a heater), and the working means A is driven by expansion of the working gas to provide a power output which can be used to drive an external apparatus not shown.

In FIG. 3, a heat pump for cooling purposes has a fixed structure 1 carrying a rotatable shaft 2 driven by an electric motor 3, a compressor 5, and drive means including a mechanism 4 transmitting and changing the purely rotary motion of the shaft 2 into reciprocatory rotary motion to drive the compressor 5. The compressor 5 is arranged to compress a working gas so that heat is dissipated to atmosphere by a series of heat exchangers 6, the compressed gas being displaced by a displacer piston 7 to a cooling region shown generally at 9. The displacer piston 7 is driven from the shaft 2 by a further mechanism 8 forming part of the drive means. The piston 7 itself includes at least one regenerator element through which the working gas passes on displacement.

As shown in FIG. 3, the shaft 2, the electric motor 3, the mechanism 4, the compressor 5, and the displacer piston 7 are all arranged either coaxially with or symmetrically around an axis X—X being the rotational axis of the shaft 2 and the axis of symmetry of the heat pump itself.

Figure 4:
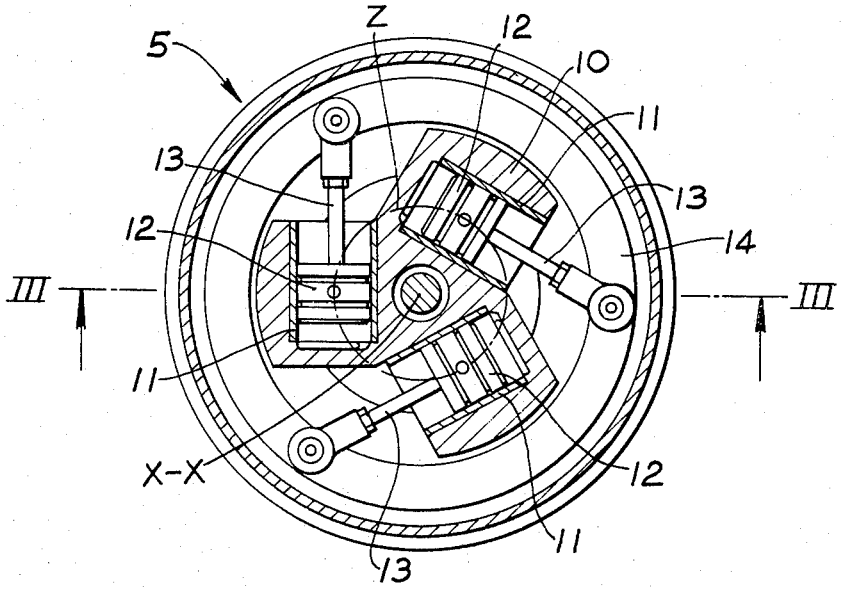
FIG. 4 is a cross-section taken about line IV—IV of FIG. 3.

Referring now to FIG. 4, the compressor 5 comprises a cylinder block 10 which forms part of the fixed structure 1 and has three cylinders 11 formed therein. Each cylinder 11 has a piston 12 with a connecting rod 13 connecting its piston to an annular shaped rotatable member 14 carried by the fixed structure 1 for reciprocatory rotational movement. The cylinders are arranged symmetrically about the axis X—X with the axes of reciprocation of the pistons being tangential to an imaginary circle, referenced Z in FIG. 4, centred upon that axis.

The cylinders 11 are in gas flow communication with the heat exchangers 6 and also with the cooling region 9 by way of the regenerator or regenerators included within the displacer piston 7.

The rotatable member 14 is caused to reciprocate through an angular movement to effect simultaneous movement of the pistons 12 through one cycle (i.e. from BDC to TDC and back to BDC) by the mechanism 4.

Referring now to FIG. 5, the mechanism 4 comprises a primary gear wheel 15 fixedly carried on the shaft 2 and driving three secondary gear wheels 16 which are constrained to mesh with the wheel 15 by being rotatably carried on a carrier plate 17. The carrier plate 17 is part of the fixed structure 1. Each wheel 16 carries a connecting rod 18 connecting it to the rotatable member 14, each wheel 16 and its associated connecting rod 18 forming a simple crank mechanism which converts the purely rotary movement of each wheel into a reciprocatory rotary movement of the rotatable member 14. The connecting rods 18 are not shown in FIG. 3 but it will be noted that one end of which is connected to a crank pin 19 on each wheel 16 and that the other end of each is connected to a similar crank pin 20 on the rotatable member, the rotatable member naturally carrying three such pins 20 symmetrically spaced. The crank mechanism is such that the compression stroke of the piston is achieved in less time than the expansion stroke. This beneficial result is due to the crank pins 20 moving in a circular arc with the rotatable member 14.

Referring now to FIG. 6, the displacer piston 7 is operated by further mechanism 8 which itself is driven from the shaft 2. This latter shaft 2 carries an annular cam track 21 on an extended portion adjacent the wheel 15. This track is undulatory and has a follower 22 in the form of a roller carried on a rocker 23. The latter is pivoted to a push-pull rod 24 at 25, and has an arcuate surface 26 around which is anchored a leaf spring 27. The leaf spring is further anchored to an opposed surface 28 of the fixed structure 1 so that the arcuate surface 26 and its associated portion of the leaf spring 27 are effectively constrained to rock about the opposed surface 28 whilst the follower 22 is constrained to roll around the track 21. The arrangement is such that the push-pull rod 24 is reciprocated along the axis X—X thereby moving the displacer piston 7 in a fashion predetermined by the contour of the track 21. It is evident that the track contour and/or angular position can be varied during build to effect any desired phase angle (that is to say the timing) between the mechanical operational cycle of the compressor 5 and the mechanical operational cycle of the displacer piston 7. In practice, that of the displacer piston 7 leads that of the compressor.

To vary the phase angle during operation, timing changing means can be provided. Such means may take those alternative forms described with reference to FIGS. 7 and 8.

In the embodiment of FIG. 7 slide means are mounted on the carrier plate 17 and are arranged to carry the gear wheels 16. Each gear wheel is carried on one slide unit 29 of the slide means, and each slide unit is slidable with reference to the carrier plate 17 in a radial direction. Slidable movement of each unit is effected by a solenoid 30 acting to move its respective slide unit radially outwards against the bias of a spring (not shown) to move its gear wheel 16 temporarily out of mesh with the primary gear wheel 15. Naturally, the units are moved simultaneously with one another. Whilst the gear wheels 16 are out of mesh, the primary gear wheel is moved through a desired angular amount and the gear wheels are then allowed to move radially inwards to again acheive meshing.

In the embodiment of FIG. 8, the shaft 2 is provided with clutch means mounted between it and the cam track 21. The clutch means comprises two serrated faces 31 and 32, that referenced 31 being formed upon the base of the cam track 21 and that referenced 32 being formed upon a suitably enlarged portion of the shaft 2. The face 31, and the cam track 21, are movable away from the face 32 by means of a rod 33 lying coaxially with the shaft and actuated against the bias of a spring (not shown) by a solenoid 34. Thus the drive to the displacer piston 7 can be temporarily disconnected, allowing the shaft 2 to be rotated through a predetermined angular amount, whereupon the faces 31 and 32 are re-engaged and drive to the displacer piston 7 is again established.

The described invention enables a Stirling cycle cooler to be designed having the output range characteristics shown in the graphs of FIGS. 9 and 10. In these Figures:

C of P—is the theoretical ratio of heat lift from the minimum working fluid temperature to the maximum working fluid temperature divided by the power supply to the apparatus when friction and other losses are ignored.

S—is a simple function of the working fluid volume not swept by pistons multiplied by the product of the maximum and minimum working fluid temperatures, divided by the total displacer piston swept volume multiplied by the sum of the maximum and minimum working fluid temperatures.

C.S.A.—is the total compressor piston cross sectional area.

Pmax—is the maximum working fluid pressure.

$\alpha$—is the phase angle by which the displacer motion leads the working piston motion.

Mean Torque—is the average torque required to drive the apparatus when friction and other losses are ignored and helium gas is the working fluid.

The described apparatus has the following other characteristics:

Minimum working gas temp = 80° K.

Maximum working gas temp = 400° K.

The distance from the centre of wheels 16 to the axis X—X = 36 mm

The distance from the pins 19 to the centre of the wheels 16 = 11 mm

The distance from the pins 35 to the axis X—X = 45 mm

The distance from the pins 20 to the axis X—X = 32 mm

The length of members 13 = 40 mm

The length of members 18 = 30 mm

The distance of the cylinders 11 from the axis X—X, i.e. the radius of circle Z = 20 mm As alternatives to the three cylinders 11 arranged at 120° to one another in the compressor 5, there can be two cylinders arranged at 180° or four cylinders arranged at 90° to one another. To reduce any backlash in the mechanism 4 one connecting rod 18 can be of a different length in comparison with the other two. Additionally or alternatively, one connecting rod 18 can be fashioned as a spring so that its force is balanced by forces in the other two rods and additional gear contact loads.

To assist heat flow to atmosphere from the heat exchangers 6, known forms of heat pipe may be provided in the fixed structure 1.

The described arrangement has particular use in heat pumping apparatus arranged to effect cooling of electro-optical military surveillance equipment. To this end it utilises the known attributes of high performance and long unattended life associated with Stirling cycle apparatus but in addition has the attributes of low vibration since the compressor 5, together with its drive means, is dynamcally balanced and the only force transmitted to the fixed structure is a pure torsion couple. This low vibration improves the performance of the electro-optical equipment and reduces the risk of detection by an enemy.

Since the displacer means is driven separately from the working means, the difference in phase between their mechanical operational cycles can be selected either during build or during operation to provide a desired performance; it is found that this performance increases significantly in a heat pump cooler as the angle by which the displacer piston motion leads the compressor motion is progressively changed from 90°, and in a prime mover as the angle by which the displacer piston motion lags the compressor motion is progressively changed from 90°.

I claim:

1. Stirling cycle apparatus, including:

working means for cyclically compressing or expanding a working fluid, displacing means for cyclically displacing the working fluid, rotatable shaft means, and drive means operatively associating the working means and the displacing means with the shaft means;

the working means including a plurality of piston/-cylinder units symmetrically disposed with the axis of reciprocation of the pistons tangential to an imaginary circle lying in a plane normal to the rotational axis of the shaft means and centred upon said rotational axis.

2. Stirling cycle apparatus according to claim 1 wherein said displacing means includes a reciprocating piston.

3. Stirling cycle apparatus according to claim 2 wherein the drive means further includes a cam and follower arrangement to effect reciprocation of the reciprocating piston.

4. Stirling cycle apparatus according to claim 3, wherein:

the cam and follower arrangement comprising an annular cam track member rotating with the shaft means and a roller follower constrained to follow said track.

5. Stirling cycle apparatus according to claim 4 in which said means associated with said drive means includes timing changing means arranged to vary the relative timing of the cycles of the compression means and the displacing means during operation, wherein the timing changing means comprises clutch means operatively mounted between the shaft means and the cam track member, and means to effect temporary disengagement of the clutch means.

6. Stirling cycle apparatus according to claim 1, wherein:

the drive means including a rotatable member coaxially mounted with the shaft means, a mechanism arranged to effect reciprocatory rotational movement of the rotatable member, and connecting means connecting the pistons to the rotatable member.

7. Stirling cycle apparatus according to claim 6, wherein:

said mechanism comprises a primary gear wheel coaxially mounted with and driven by the shaft means, at least one secondary gear wheel meshing with the primary gear wheel, and crank means coupling the or each secondary gear wheel to the rotatable member such that whilst the gear wheels rotate the rotatable member reciprocates.

8. Stirling cycle apparatus according to claim 7, wherein:

the crank means are arranged such that the piston compression stroke occupies a different time interval to the piston expansion stroke.

9. Stirling cycle apparatus according to claim 7 in which said means associated with said drive means includes timing changing means arranged to vary the relative timing of the cycles of the compression means and the displacing means during operation, wherein the timing changing means comprises radially extending slide means upon which the or each secondary gear wheel is carried, and actuation means to move the slide means radially so that the or each secondary gear wheel is moved temporarily out of mesh with the primary gear wheel.

10. Stirling cycle apparatus, including:

working means for cyclically compressing or expanding a working fluid, displacing means for cyclically displacing the working fluid, rotatable shaft means, and drive means operatively associating the working means and the displacing means with the shaft means, means associated with said drive means for altering the relative timing of the mechanical operating cycles of the compression means and the displacing means;

said displacing means including a recriprocating piston;

said drive means further including a cam and follower arrangement to effect reciprocation of the reciprocating piston;

the cam and follower arrangement comprising an annular cam track member rotating with the shaft means and a roller follower constrained to follow said track.

11. Stirling cycle apparatus according to claim 10 in which said means associated with said drive means includes timing changing means arranged to vary the relative timing of the cycles of the compression means and the displacing means during operation, wherein the timing changing means comprises clutch means operatively mounted between the shaft means and the cam track member, and means to effect temporary disengagement of the clutch means.

12. Stirling cycle apparatus, including:

working means for cyclically compressing or expanding a working fluid, displacing means for cyclically displacing the working fluid, rotatable shaft means, and drive means operatively associating the working means and the displacing means with the shaft means, means associated with said drive means for altering the relative timing of the mechanical operating cycles of the compression means and the displacing means;

the working means including a plurality of piston/-cylinder units symmetrically disposed with the axes of reciprocation of the pistons tangential to an imaginary circle lying in a plane normal to the rotational axis of the shaft means and centered upon said rotational axis;

the drive means including a rotatable member coaxially mounted with the shaft means, a mechanism arranged to effect reciprocatory rotational movement of the rotatable member, and connecting means connecting the pistons to the rotatable member.

13. Stirling cycle apparatus according to claim 12 wherein said mechanism comprises a primary gear wheel coaxially mounted with and driven by the shaft means, at least one secondary gear wheel meshing with the primary gear wheel, and crank means coupling the or each secondary gear wheel to the rotatable member such that whilst the gear wheels rotate the rotatable member reciprocates.

14. Stirling cycle apparatus according to claim 13 wherein the crank means are arranged such that the piston compression stroke occupies a different time interval to the piston expansion stroke.

15. Stirling cycle apparatus according to claim 13 in which said means associated with said drive means includes timing changing means arranged to vary the relative timing of the cycles of the compression means and the displacing means during operation, wherein the timing changing means comprises radially extending slide means upon which the or each secondary gear wheel is carried, and actuation means to move the slide means radially so that the or each secondary gear wheel is moved temporarily out of mesh with the primary gear wheel.

* * * * *